United States Patent [19]

Metzler

[11] Patent Number: 4,948,437

[45] Date of Patent: Aug. 14, 1990

[54] PROCESS FOR THE HEAT-AFTER TREATMENT OF A PIG IRON PORT

[75] Inventor: Horst Metzler, Tuttlingen, Fed. Rep. of Germany

[73] Assignee: Schwabische Huttenwerke GmbH, Fed. Rep. of Germany

[21] Appl. No.: 155,040

[22] Filed: Feb. 11, 1988

[30] Foreign Application Priority Data

Feb. 14, 1987 [DE] Fed. Rep. of Germany ..... 3704679

[51] Int. Cl.[5] ..... C21D 5/00

[52] U.S. Cl. ..... 148/138; 148/134

[58] Field of Search ..... 148/321, 138, 2; 420/15

[56] References Cited

FOREIGN PATENT DOCUMENTS 53-137814 12/1978 Japan ..... 148/321

60-24703 12/1985 Japan ..... 148/321

*Primary Examiner*—Deborah Yee

*Attorney, Agent, or Firm*—Davis, Bujold & Streck

[57] ABSTRACT

A iron alloy material for the manufacture of brake drums, specially of massive and ventilated brake discs and other braking bodies, which has a pearlitic structure with a 5% maximum portion of ferrite, and a tensile strength of at least 200N/mm$^2$ and consists essentially of:

carbon in an amount of 3.62 to 3.68 weight %;

silicon in an amount not exceeding 2.10 weight %;

manganese in an amount of 0.70 tp 0.85 weight %;

phosphorus in an amount of less than 0.080 weight %;

sulfur in an amount of less than 0.095 weight %;

chromium in an amount of 0.18 to 0.25 weight %;

molybdenum in an amount of 0.30 to 0.45 weight %;

copper in an amount of 0.30 to 0.45 weight %; and iron in an amount of 92.045 to 94.9 weight %.

1 Claim, No Drawings

PROCESS FOR THE HEAT-AFTER TREATMENT OF A PIG IRON PORT

The invention concerns pig iron alloys for the manufacture of brake drums, massive and ventilated brake discs and other braking bodies having an alloy of over 3.6% carbon
0.6 to 0.9% manganese
1.8 to 2.5% silicon
less than 0.1% phosphorus
less than 0.12% sulfur
and small component parts of chromium, molybdenum
and copper
the pig iron having a pearlitic structure.

A pig iron alloy having this chemical composition has been described in DE-OS 33 05 184. Due to the development of new asbestos-free brake linings, it has become necessary also to use in brake drums, brake discs and the like, pig iron alloys that tolerate elevated temperatures. In this connection, the general tendency among the users has hitherto been toward employing iron sorts of high heat resistance and high carbon contents, but this has disadvantages, specially in relation to a coarse texture and to strength.

DE-OS 33 05 184 proposed a material for braking bodies which was to have, on one hand, sufficient strength and on the other hand, a good heat conductivity and high damping property. In said publication it was said that even with low strength values the hot tensile strength at extremely high temperatures of GG 30 (GG is International Standard for Grey Iron) is only insignificantly higher or almost equal to that of GG 15. The grey cast iron of relatively low strength must in addition have less internal stresses, must become less heated during machining on account of the carbon content and must have under thermal load less warp phenomena than the grey cast iron of higher strength hitherto used.

However, it has been shown in the practice that this grey cast iron has no small amounts of ferrite portions. But ferrite portions in the brake drum have the disadvantage that the friction match, that is, the friction coefficient between the brake linings and the brake drums or brake discs, changes. This means that the delay when braking is less. Thus, if possible, as high as 100% pearlitic structure would be optimal.

Besides, it has been found that in many cases the tensile strength of this pig iron is not sufficient.

This invention is based on the problem of providing a pig iron of the type mentioned at the beginning which has the least possible portions of ferrite together with high tensile strength.

According to the invention this problem is solved by an alloy having a combination of the following features, namely, a pearlitic structure with the maximum portion of ferrite of 5% and a tensile strength of at least 200 N/mm$^2$ and consisting essentially of:

carbon in an amount of 3.62 to 3.68 weight %;
silicon in an amount not exceeding 2.10 weight %;
manganese in an amount of 0.70 to 0.85 weight %;
phosphorus in an amount of less than 0.080 weight %;
sulfur in an amount of less than 0.095 weight %;
chromium in an amount of 0.18 to 0.25 weight %;
molybdenum in an amount of 0.30 to 0.45 weight %;
copper in an amount of 0.30 to 0.45 weight %; and
iron in an amount of 92.045 to 94.9 weight %.

Due to the alloy components such as chromium, molybdenum, manganese and copper, which were established in lengthy tests there is obtained a tensile strength of at least 200 N/mm$^2$.

It has additionally been found in a surprising manner that copper and also molybdenum have a stabilizing effect on the pearlitic, and this without leading to precipitations of carbide. It was found that with the pig iron according to the invention there can be obtained a 100% pearlitic structure.

Molybdenum in addition produces, in combination with chromium, a high core strength of the structure and as alloy component gives good heat resistance under alternating thermal loads of the brake discs. The carbon content of up to a maximum of 3.68% is obtained by smelting in the cupola furnace at C (Carbon) level 0.34 to 3.45%. The remaining 0.25 to 0.30% is introduced by a special inoculation process when tapping the fluid iron in the casting ladle by means of electrode graphite. The resulting optimal inoculation allows A-graphite of the size 3–4 to generate. It was surprisingly found here that carbide precipitations do not occur in the pearlitic structure despite alloy elements thereof such as chromium and molybdenum.

The high carbon content causes many graphite precipitations with their surprising properties for brakes of heat conductivity and high thermal resistance. This means that the accumulation of heat on the brake friction rings can be distributed in the shortest time over the whole disc whereby thermal stresses and cracks from overheating are clearly reduced.

It is also an advantage that due to the absence of carbide precipitations in the pearlitic structure there result no roughened surfaces, cracks produced by the expansion flaws in the friction ring surfaces and the appearance of hotspots. The disadvantageous pulsing of the brake pedal due to hardness variations of the discs in the materials hitherto used, insofar as this is caused by the material itself, is eliminated by the pig iron according to the invention.

Since silicon considerably reduces the heat conductivity, a component part of 2.1% must not be exceeded, for this property works against the desired quick heat distribution in the disc. The given value of 0.08% for phosphorus must not be exceeded in order to prevent steatite and therewith hard components in the structure.

Sulfur is brought up to a maximum of 0.095% to obtain the manganese-sulfur ratio, but it should not exceed said value.

In the pig iron according to the invention there results a fine texture and the graphite lamina become somewhat shorter whereby can be achieved the high resistance according to the invention. A high carbon portion by itself works against this, that is, produces a reduction of strength and a coarse texture. Besides, a high carbon portion represents a cost item. In lengthy tests it has now been found that, contrary to the general opinion, it is possible to make do with small carbon contents, specifically in the established range of from 3.62 to 3.68% when this is combined with the other alloy components. In this case, the desired high strength and heat resistance are achieved.

To temper the cast parts (artificial aging) after having been produced, there is proposed according to the invention a heat after-treatment known per se which in an inventive manner has been adapted to the pig iron according to the invention.

In this connection it is proposed according to the invention that the parts to be treated be heated over 180 minutes to a temperature of from 650 to 720° C. and then kept at this temperature for 30 minutes after which a slow cooling to 250° C. takes place in the annealing furnace.

Prior to annealing the parts must be pre-machined; namely scrubbed. The skin of the rubbing surfaces and of the inner bottom of the container must be removed (about 1.5 mm.) By the heat after-treatment that follows according to the invention, there are eliminated both internal stresses and stresses resulting from the machine. It is also of the essence here that the higher internal stresses that can be generated as result of the increased strength obtained in a certain area by the alloy components can be prevented by the heat after-treatment according to the invention.

In this manner there are still needed after the heat treatment only small machine operations whereby a renewed appearance of stresses can be avoided.

It has been found that by said longer heating time for the parts to be treated their warping can be prevented. The cooling after the indicated thermal retardation must in any case be slow so that no new stresses generate. This can be obtained in a simple manner, for instance, by disconnecting the annealing furnace, the parts remaining for a still longer time in the annealing furnace that is slowly cooling.

I claim:

1. A process for the heat-after treatment of a part made from iron, containing:

carbon in an amount of 3.62 to 3.68 weight %;
silicon in an amount not exceeding 2.10 weight %;
manganese in an amount of 0.70 to 0.85 weight %;
phosphorus in an amount of less than 0.080 weight %;
sulfur in an amount of less than 0.095 weight %;
chronium in an amount of 0.18 to 0.25 weight %;
copper in an amount of 0.30 to 0.45 weight %;
molybdenum in an amount of 0.30 to 0.45 weight %; and
iron in an amount of 92.045 to 94.9 weight %; comprising the steps of:

(a) heating said part to a temperature of from 650 to 720° C. over a period of about 180 minutes;
(b) maintaining said part at that temperature for about 30 minutes; and then
(c) slowly cooling it to 250° C. in an annealing furnace to produce a pearlitic structure without carbide precipitation.

* * * * *